United States Patent [19]

Beckers et al.

[11] 4,220,269

[45] Sep. 2, 1980

[54] SLIDE GATE NOZZLE FOR A CASTING VESSEL

[75] Inventors: Karl D. Beckers, Neunkirchen-Seelscheid; Eckart Hees, Dinslaken; Gerhard Bauer, Moers, all of Fed. Rep. of Germany

[73] Assignees: Martin & Pagenstecher GmbH, Cologne; Thyssen Aktiengesellschaft, vorm. August Thyssen-Hütte, Duisburg, both of Fed. Rep. of Germany

[21] Appl. No.: 934,182

[22] Filed: Aug. 16, 1978

[30] Foreign Application Priority Data

Aug. 16, 1977 [DE] Fed. Rep. of Germany ..... 2736817

[51] Int. Cl.[2] ..... B22P 41/08

[52] U.S. Cl. ..... 222/600; 137/315; 251/326

[58] Field of Search ..... 137/315; 251/326, 329; 222/600

[56] References Cited

U.S. PATENT DOCUMENTS 3,937,372 2/1976 Bode, Jr. ..... 222/600

FOREIGN PATENT DOCUMENTS 505520 11/1974 U.S.S.R. ..... 222/600

*Primary Examiner*—David A. Scherbel

*Attorney, Agent, or Firm*—J. Harold Nissen

[57] ABSTRACT

A slide gate nozzle for a slide gate carried by a closure frame which includes two independent arms pivotally connected with a casting vessel for slidably moving the slide gate with respect to the casting vessel and for moving the slide gate away from the vessel to facilitate changing of the ceramic plates. Rocker frames are pivotally connected with the arms and include rollers on which a guide rail rides in the sliding direction of the slide gate, and the swivelly connected rocker frame assures even pressure of the ceramic plates.

9 Claims, 8 Drawing Figures

1
3
4
5
8
24
25
7
6
2
21
16
9
9b 8
23
4
15
III
III
12a
11a
3
14a
10a
11a
12a
28
9a
16
27
17

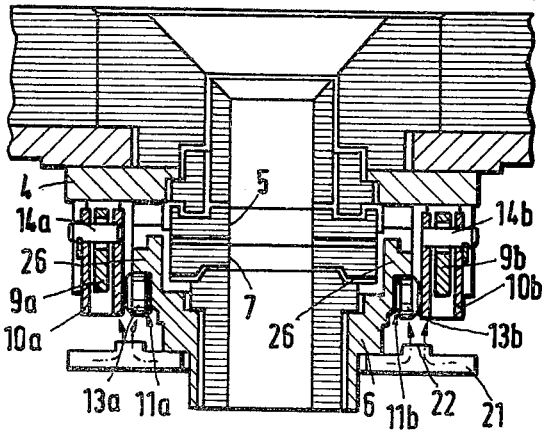
Fig.3
Fig.8
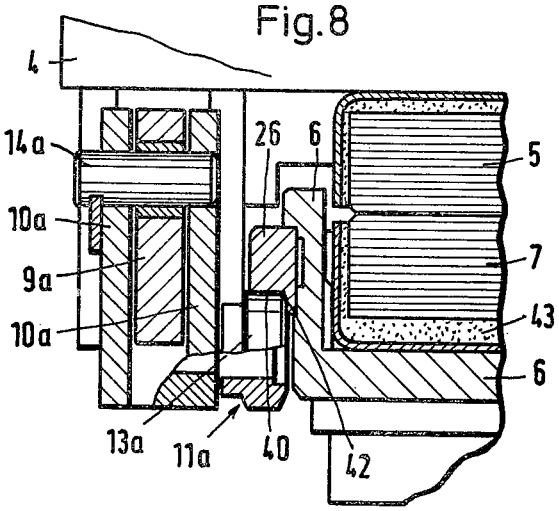
Fig.4
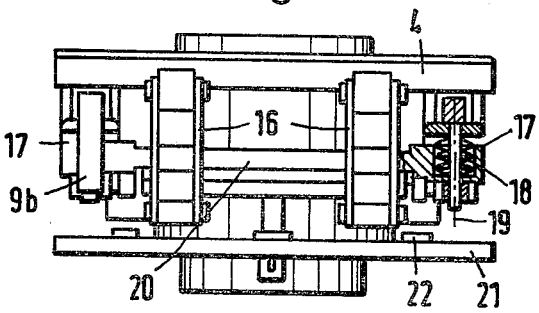

SLIDE GATE NOZZLE FOR A CASTING VESSEL

BACKGROUND OF THE INVENTION

1. Field of the Invention

The invention relates to a slide gate nozzle for a casting vessel having a discharge opening. More particularly, the slide gate nozzle includes a slide gate housing for accomodating a slide plate. The housing is slidable in guide elements which extend therein in a sliding direction and can be pressed upwards with the sliding plate against a head plate by means of a closure frame which is supported by elastic means against the casting vessel.

2. Description of the Prior Art

Slide gate closures work according to the principle of two ceramic plates each provided with one or more bore holes which are slid hydraulically or electrically one over the other. When in an open position, two bore holes are in alignment, whereas in a closed position, two bore holes are out of alignment with each other. In the intermediate position, it is possible to regulate the casting stream.

A slide gate nozzle of the aforementioned type forms part of the prior art and is known from German Offenlegungsschrift No. 2,545,514 (West Germany).

This known slide plate closure has a closure frame which can be swung out to replace the slide plate. One end of the closure frame is pivoted at a frame secured to the bottom of the casting vessel, while the other end is connected to the side wall of the casting vessel by means of adjustable springs. Runners having slide gibs are provided as guides for the slide gate housing; these runners for their part when viewed in the longitudinal direction of the slide plate are disposed with a convex bottom surface in a concave carrier bar. The runners can move backwards and forwards with the convex bottom surface on the concave slide gibs in order to transfer the forces produced more evenly. A certain amount of adjustment in balance in longitudinal direction is possible with this construction, but this adjustment in balance is restricted by the fixed construction of the closure frame. With excessive friction, transverse forces can arise which are not absorbed by the fixed closure frame, and these forces can cause a lateral canting between the runner and the slide gate housing. Then, there is also the danger of the slide plate becoming slightly inclined which can result immediately in steel becoming discharged laterally between the head plate and the slide plate. Moreover, there is also the danger of the slide gibs and the runners becoming clogged and thereby causing excessive friction in the runners.

W. German Offenlegungsschrift No. 2,411,800 discloses a rotatable sliding nozzle for casting ladles in which the slide plate is swivelly arranged on slide rollers. Four rollers, each of which are staggered at 90° are arranged in a housing frame for this purpose. This roller arrangement can have the advantage that the sliding frictional forces are reduced. However, when uneven forces arise due to abrasion or clogging of the rollers, there is no certainty or guarantee with this prior known arrangement. According to a preferred embodiment of this prior art, the rollers have a truncated-cone-like running surface, on which the conical running surface of the slide gate housing can center itself. A certain balance can be achieved by this, but there is no guarantee that the slide gate will be well sealed by this balance.

SUMMARY OF THE INVENTION

An object of the present invention is to develop a simple construction for a slide gate closure which guarantees or assures an even pressure between the head plate and the slide plate over a longer period of time.

Another object of the invention is to provide a slide gate constructed in such a way that the operability of the slide gate closure is also guaranteed as well as assured when there are slight inaccuracies or misalignments between the head plate and the slide gate when they are assembled.

A further object of the invention is when they are assembled to reduce the danger of clogging which can lead to premature failure of the slide gate closure.

The present invention proposes to accomplish the aforesaid objects by positioning the guide elements for the slide gate in two rocker frames; and, each of the rocker frames is arranged in the closure frame in one of two independent lever arms on a pivoting axis which runs or extends transversely to the sliding direction. Preferably the guide elements are in the form of roller guide elements. It is possible to have the two ends of the lever arms supported directly on the casting vessel. It is also possible to have the lever arms indirectly supported by the casting vessel, by having the lever arms connected with the bottom housing which is secured to the casting vessel and which accommodates the head plate. In order to facilitate a quick replacement of the slide plate, the lever arms are pivoted at either one end to the casting vessel or bottom housing, respectively, and a snap closure is provided at their other end of the casting vessel. It is possible in the case of this construction to support the linking point against the casting vessel or the bottom housing by elastic means. However, this is not absolutely necessary. A simple construction has proved sufficient in which the support is undertaken by elastic means of the half of the lever arm lying away from the linking point. The support is preferably achieved approximately at the height of the snap closure, i.e. at the end of the lever arm which is furthest removed from the linking point. Pressure sleeves have proved to be effective as the elastic means; these pressure sleeves can be secured to the bottom housing or to the casting vessel by the snap closure. A cross-strut with the pressure sleeves positioned on its ends can be provided for this purpose. The two pressure sleeves are then inserted into sections provided at the end of the respective lever arm so that they press the two lever arms upwards. The setting pressure is adjusted by regulating means. Pressure sleeves accommodating plate springs for example, have proved effective. The pressure sleeves secured on the cross-strut permit free movement in the direction of the pressure of each of the liver arms against the force of the plate springs. The swing path of the lever arm can, for example, amount here to 5 to 15 mm. The interdependent movements of the two lever arms enable an adjustment to the balance in a transverse direction of the end plate and the slide plate.

An essential feature to assure the operability of the novel construction is to have the roller guide, which facilitates the movement of the slide gate, arranged to oscillate in both lever arms by a rocker-type construction. The rocker-type construction includes rocker frames arranged in the two lever arms to undertake the adjustment in balance of the longitudinal axis. According to a particularly advantageous construction, roller guidance is provided by a front and a rear roller bearing. A pivoting axis is arranged between the front and rear roller bearings in such a manner that the axis of the roller bearings and the swivelling axis form the angle points of an obtuse-angled isosceles triangle, i.e. the angle between the two equal sides is an obtuse angle. In this construction, the roller bearings are mounted so as to overhang the swivelling axis of the rocker frame so that an adjustment in the balance in the longitudinal axis is guaranteed or assured. In this sense, the pivoting axis can also be described as a balancing point, whereby a roller bearing is arranged on both sides of the balancing point and at a distance from the balancing point. In cooperation with the adjustment in the balance in the longitudinal axis (rocker frame), the pressure sleeves effect adjustment in the balance in a transverse direction so that all forces will balance out freely so as to adjust the balance position. Tubular bearings which provide a particlarly good screening from clogging have proved themselves useful as the roller bearings. The roller bearings guarantees or assures very easy sliding. Pressing of the slide plate onto the end plate is achieved, starting from the pressure sleeves, via the closure frame (lever arms), then via the pivoting axis onto the rocker frame, from the rocker frame onto the roller bearing and then from the roller bearing onto the slide gate housing.

According to a particularly preferred construction, the lever arms are positioned alongside the slide gate housing and are transversely spaced therefrom. For expedience, the distance is chosen in such a way that the rollers can be arranged with their bearings between the vertical side walls of the slide gate housing and between the lever arms. A rail is then secured to the vertical side walls of the slide gate housing, on which rail the slide gate housing runs on the rollers. This construction has two essential advantages. As both the lever arms and the roller bearing are situated approximately at the height of the end plate and the slide plate, a low overall height results which has considerable advantages in continuous casting plants. The free distance, in the transverse direction, between the lever arm and the slide gate housing has the advantage that on the whole an open construction is produced, and therefore, the vapors and dirt which result can escape freely; air can issue in, and the whole construction is maintained at a reasonable temperature by the air being freely drawn in from the outside.

In addition, however, it may be expedient to arrange a screening plate which is secured at the side gate housing and extends in the sliding direction. This screening plate can be provided with slits below the roller guide which extend in the sliding direction and to which, in addition, cooling means is supplied by means of a compressed air conduit. In this way, the temperatures in the area of the roller bearings can be held at below 200°, whereby the blown-in cooling air carries off tar vapors still being produced and appearances of clogging are prevented.

For expedience, the pivoting axis is arranged in the lever arms so as to be adjustable in the sliding direction. The lever arms can have a plurality of transverse borings for this purpose, in which the swivelling axis can be secured; the lever arms could also have a continuous slit so that adjustment can be achieved continuously. The swivelling axis is preferable arranged in the lever arms in such a way that it is situated at a point approximately half-way between the open and closed positions of the slide plate.

It has proved expedient to guide both lever arms during their spring movement vertically between guide surfaces. For this purpose, guide surfaces, which are for example open at the bottom, can be provided on the bottom housing so that the lever arms themselves cannot execute too great an amount of movement in the transverse direction.

The movement of the slide gate housing can be achieved in a known way, e.g. hydraulically. It is recommended that a bayonet lock be arranged at the front end of the slide mechanism to ensure quick installation and removal of the hydraulic means. In order to allow the slide gate housing to execute vertical movements in relation to the slide mechanism for the desired adjustment in balance, it is expedient to provide a connection, in the form of a dovetailed guide element extending vertically as the connection.

The particular advantages of the construction according to the invention can be summarized in the following paragraphs.

The rocker and oscillating system assures or guarantees a parallel and even support of the slide plate against the head plate itself, particularly in the case of delay and technically based in accuracies in installation, e.g. an inclined position of the head plate and slide plate. This results in a constant slide pressure. This even applies for the particular case where the end plate and slide plate are not produced with very high production tolerances or if some steel slivers have penetrated into the slide surface due to abrasion. The forces arising can then be balanced out freely without having to be selected at a higher point. Thus, only a low hydraulic pressure is necessary for the adjustment, and therefore, the necessary hydraulic apparatus can be correspondingly small in dimension.

Due to the automatic adjustment in balance, it is even possible to use plates without sheet metal frames, i.e. a sheet metal holder for the head plate in the bottom housing and the slide plate in the slide gate housing. In contradistinction to this, in the known constructions, the ceramic plates must, however, be placed into a sheet metal holder. This sheet metal holder is already necessary for absorbing the pressure of the pressure springs alone. In the case of the subject of the invention, the ceramic plate can be directly secured in the slide gate housing or bottom housing, respectively, without a sheet metal holder by means of mortar or by means of a suitable clamping device. Even if there should be several millimeters difference in the height, here a balance is automatically adjusted due to the construction according to the invention, and therefore, no steel can penetrate between the plates; and, sliding is still possible with low sliding forces.

A further essential advantage is that because of the open construction, the tar vapor which are residues produced can freely escape out of the refractory material of the plates. The danger of clogging is thereby considerably reduced. The construction is also easy to maintain since it is an open construction. The slide gate closure in its preferred construction has only a shallow overall height. This is important for the continuous casting operations.

These and other objects, features, and advantages of the present invention will be more fully realized and understood from the following detailed description when taken in conjunction with the accompanying drawings wherein:

BRIEF DESCRIPTION OF THE DRAWINGS

FIG. 3 is a sectional view taken on line III—III of FIG. 2;

FIG. 4 is a front view, partly in section, of the slide gate nozzle;

FIG. 8 shows a detail of the left half of FIG. 3 in enlarged view.

DESCRIPTION OF THE PREFERRED EMBODIMENTS

Figure 1:
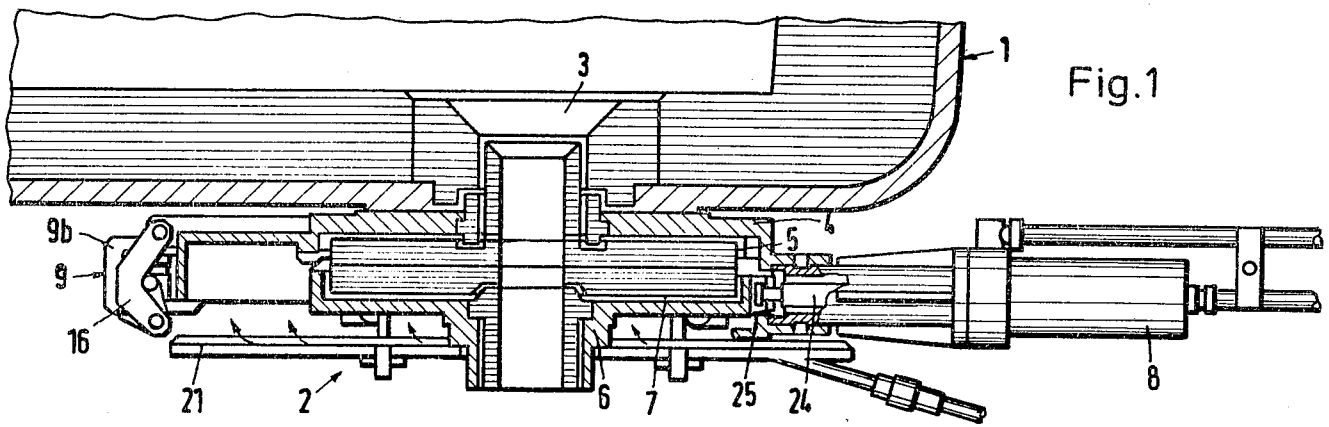
FIG. 1 is a longitudinal sectional view of a portion of a casting vessel and the slide gate nozzle attached to the open bottom of the casting vessel.

Referring to the drawings, and more particularly to FIG. 1, a casting vessel or ladle 1 and a slide gate nozzle 2 connected thereto is shown. Casting ladle 1 is provided with a bottom or discharge opening 3 under which the slide gate nozzle is situated.

Slide gate nozzle 2 includes a bottom housing 4 fixed to the floor or base of the casting ladle 1 and a slide gate housing 6 connected with a closure lever 9. The bottom housing contains a ceramic head plate 5, and the slide gate housing holds a ceramic slide plate 7. Each of the ceramic plates have an opening which is aligned with the discharge opening 3. The bottom housing 4 fixes and aligns the ceramic head plate 5 with the ladle 1 so that the discharge opening 3 in plate 5, and the ceramic slide plate 7 is associated with a sliding device 8 to cause the slide plates 7 to slide in a longitudinal direction transverse to the discharge opening 3 so as to align all three openings and to move the opening in plate 7 out of alignment with the discharge opening 3. The slide plate 7 which is arranged in the slide gate housing 6 is slid by means of the sliding device 8 which is exemplified in the drawings in the form of a hydraulic sliding device. The slide plate 7 which is arranged in the slide gate housing 6 is pressed upwards against the head plate 5 by the closure lever 9 so that no liquid steel can escape between the head plate 5 and the slide plate 7, except through the three openings when they are aligned or substantially aligned and open to each other.

Figure 2:
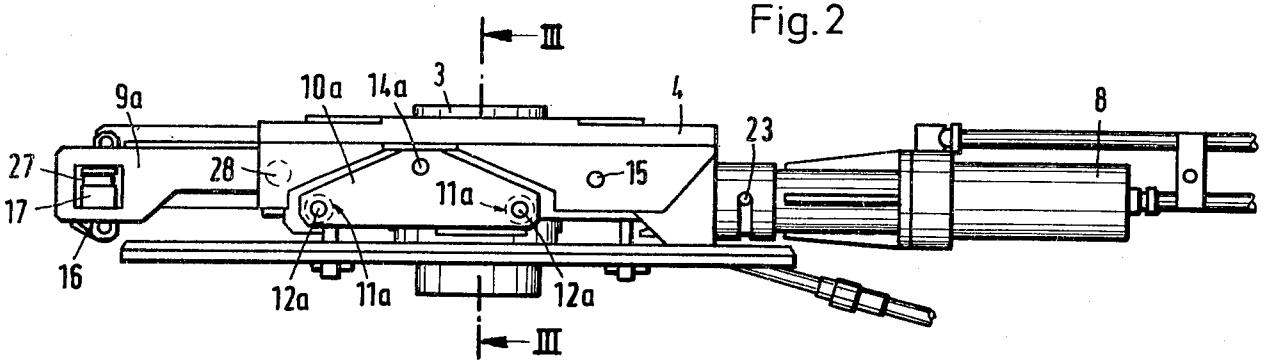
FIG. 2 is a lateral or side view of a section of the slide gate nozzle.
Figure 5:
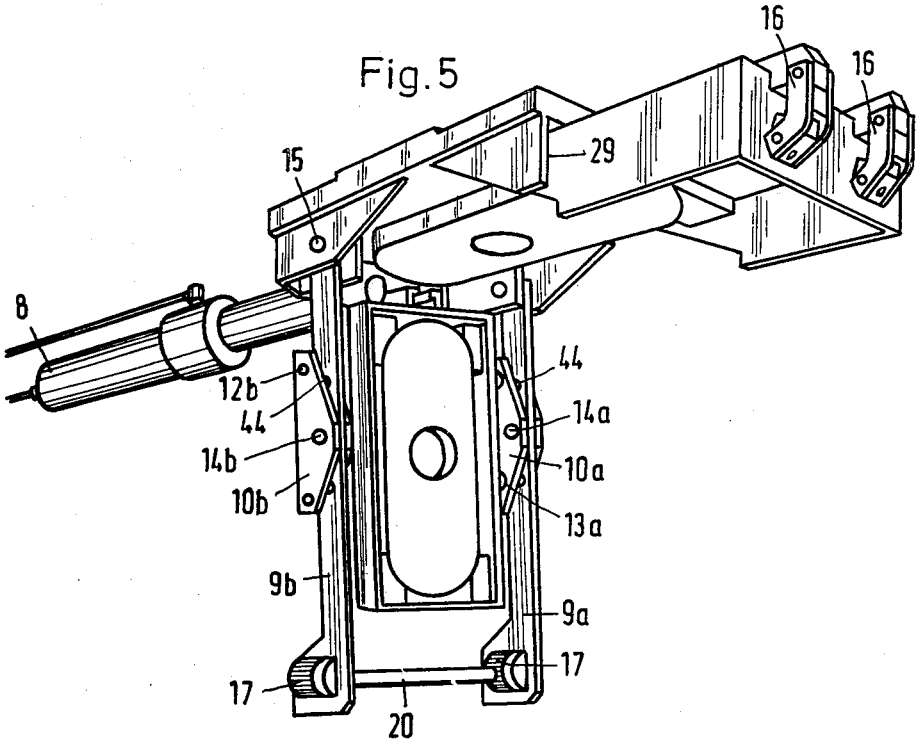
FIG. 5 is a perspective view of the slide gate nozzle shown with the slide gate housing in its open or swung out position. The slide gate nozzle is shown in a mirror image position or position rotated 180° from its FIG. 2 position.

The closure lever 9 has two independent lever arms 9*a* and 9*b*. As best seen in FIG. 2, lever arms 9*b* is positioned at the rear in the direction of vision, and lever arm 9*a* is positioned at the front in the direction of vision. As best seen in FIG. 5, which shows the sliding device 8, bottom housing 4 and slide gate housing 6 opening towards the left rather than towards the right as shown in the other figures, lever arms 9*a* and 9*b* are identical with each other. As no constructional differences exist between the lever arms 9*a* and 9*b*, the construction of the lever arms will be described as follows in connection with the lever arm 9*a*, in which the index a or b in the reference numbers in the various figures indicates that there is a corresponding part b provided in connection with the lever arm 9*b*.

As best seen in FIGS. 2, 3 and 5, associated with arm 9*a* is a rocker frame 10*a* which includes two roller guidances 11*a* formed by a roller 13*a* connected to the rocker frame 10*a* at each end thereof, and each roller 13a*a* rotates about an axis 12*a*. Rocker frame 10*a* includes connection means forming a single pivoting axis 14*a* midway between the two axes 11*a* and rollers 13*a*. Roller guidance 11*a* includes a front roller bearing and a rear roller bearing positioned on opposite sides of the pivoting axis 14*A*. When opening and shutting the slide gate nozzle 2, the slide gate housing 6 which accommodates the slide plate 7 slides over the roller guides or guidances 11*a* and 11*b* which is arranged in the rocker frame 10*a* and 10*b*, respectively. FIG. 2 shows the roller guide 11*a* arranged in the rocker frame 10*a*. The roller guide 11*a* is formed at each end of rocker frame 10*a* and is composed of two axes 12*a*, one at each end, with the roller 13*a* at each end. The roller guide 11*b* in the rocker frame 10*b* also has two axes 12*b* with a roller 13*b* at each end. In addition, while only one pivoting axis 14*a* or 14*b* is provided for each rocker frame 10*a*,10*b*, the pivoting axis 14 is not positioned in the middle of the discharge opening 3, but it is moved more to the left, as viewed in FIG. 2, towards the snap closure 16 so that the swivelling axis 14*a* is arranged approximately in the middle or half way between the open and closed positions of the slide plate 7. The position of the pivoting axes 14*a*,14*b* can be changed in the sliding direction on installation and removal of the slide plate 7. For this purpose, between the ends of lever arms 9*a*,9*b*, transverse borings 44 (FIG. 5) can be provided.

On the right end of the slide gate closure 2, as viewed in FIGS. 1 and 2, there is positioned the sliding device 8 which is secured to the bottom housing 4 by means of a bayonet lock 23. Slide gate housing 6 is connected to sliding device 8 by means of the tappet 25 for movement of the slide gate housing. A vertically extending dovetailed guide 25 is provided as a connection between the tappet 24 and the slide gate housing.

Frame 10*a* is shaped in the form of an isosceles triangle with an obtuse included angle between the two equal legs of the triangle. And, as best seen in FIG. 2, which shows a side view of the lever arm 9*a* connected with the rocker frame 10*a* which is pivoted around the pivoting axis 14*a*. The two axes 12*a* for rollers 13*a* are situated at the two acute-angled points of the triangle remote from the included obtuse angle of the obtused angle isosceles triangular configurated rocker frame. As best seen in FIGS. 2 and 5, arms 9*a* and 9*b* are pivoted about a pivot having an axis 15 and include pressure sleeves 17 which cooperate with a snap closure 16. The lever arm 9*a* is pivoted around the axis 15 to the right of the discharge opening 3 in the shown (FIG. 2) representation, whereas the pressure sleeves 17 and the snap closure 16 are positioned at the outermost end of the lever arm 9*a* and bottom housing 4 to the left of the discharge opening 3 in all figures except FIG. 5.

As best seen in FIGS. 2, 4 and 5, the pressure sleeves 17 are secured at both ends of a cross-strut 20. Two snap closures 16 are shown connected with a side of bottom housing 4 to receive cross-strut 20 when lever arms 9*a*,9*b* are positioned under housing 4 for positioning slide gate housing 6 with its ceramic slide plate 7 juxtaposed to ceramic head plate 5 and in face to face mating relationship therewith while permitting the ceramic slide plate 7 to slide relative to head plate 5. In the closed position, as shown in all figures except FIG. 5, cross-strut 20 is received in and held by snap closures 16 to press the slide plate upwards against the head plate. The two lever arms 9a,9b each have a section 27 into which the pressure sleeves 17 are inserted. The pressure sleeves 17 contain plate springs 18 (FIG. 4), the pressure force of which can be adjusted by means of regulating elements 19 after the snap closure 16 has been closed.

Referring to FIGS. 1–4, an air-cooled screening plate 21, with slits 22 open at the top, is fixed to the slide gate housing 6 below the roller guides 11a, 11b. Slide gate housing 6 also includes guide rails 26 laterally fixed thereto facing lever arms 9a,9b.

As best seen in FIGS. 3 and 8, the slide gate nozzle has a low overall height. The two lever arms 9a and 9b are situated at the height of the head plate 5 and the slide plate 7 and are horizontally spaced from the slide gate housing 6. The roller guidance 11a and 11b formed by the rollers 13a and 13b, respectively, and the guide rails 26 which are laterally fixed to the slide gate housing 6 is situated between the lever arms 9a and 9b and the rocker frames 10a and 10b respectively and the slide gate housing 6. The guide rails 26 each include a bearing surface 40 extending transversely to the axis of the discharge opening 3 and the openings in head plate 5 and slide plate 7 and extending in the direction of sliding movement of slide plate 7, and a positioning surface 42 extending substantially in a parallel direction to the axis of the discharge opening 3 and parallel to the direction of sliding of plate 7.

As FIGS. 2 and 3 illustrate combined with FIG. 5, the slide gate nozzle 2 has an open construction. The slide gate housing 6 is arranged so as to be freely movable. It runs only on the rollers 13a, 13b and only over the bearing surfaces 40 of the guide rails 26. The slide plate 7 and/or the head plate 5 can be quickly and simply changed after the cross-strut 20 has been released from the snap closure 16, and the lever arms 9a, 9b have been moved down away from bottom housing 4. In the closed condition, too strong a lateral movement of the lever arms 9a, 9b is prevented by the guide surfaces 28, 29 which are open at the bottom and are fixed to the bottom housing 4.

Figure 7:
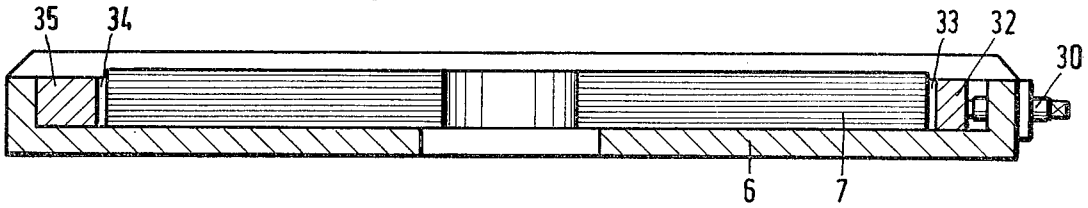
FIG. 7 is a longitudinal sectional view taken on line VII—VII of FIG. 6.
Figure 6:
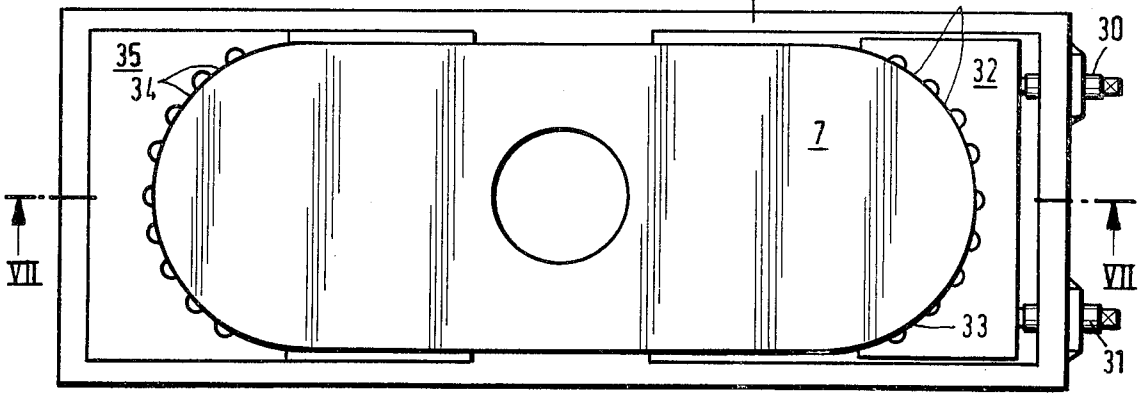
FIG. 6 is a detail of FIG. 5 showing a top view of the slide gate housing.

Referring now more particularly to FIGS. 6 and 7, the ceramic slide plate 7 can be arranged directly in the slide gate housing 6 without any additional sheet metal holder. A clamping device with two clamping bolts 30,31 acting on a first clamping jaw 32 serves as one part of a holder. The clamping jaw 32 is provided with teeth 33 which embrace one semi-circular end of the slide plate 7. The other semi-circular end is grasped by a second clamping jaw 35 which is provided with teeth 34 and serves as another part of the holder. As an alternative to this clamping device the plate 7 can also be held in the slide gate housing 6 by means of a mortar 43 (see FIG. 8), for example. The fixation of the end plate 5 in and to the bottom housing 4 is achieved in the same way.

DESCRIPTION OF THE OPERATION

The two lever arms 9a and 9b work as force transferring elements. The plate springs 18 of the pressure sleeves 17 exert their pressure force on the slide gate housing 6 via the lever arm 9a or 9b, the pivoting axis 14a, 14b, the axes 12a, 12b, the rollers 13a,13b and the guide rails 26.

It is essential that the roller guidance 11a,11b is pivoted in the lever arms 9a and 9b by means of the rocker frame 10a,10b. The pivoting arrangement of the rocker frame assures or guarantees the adjustment in balance in the longitudinal axis. In cooperation with this, the lever arms 9a and 9b assure or guarantee an adjustment in balance in a transverse direction. This is achieved by the pressure sleeves 17, which are arranged approximately at the height of the snap closure 16 in the closed condition. The transfer of force via the lever arm 9a,9b benefits the number and structure of the pressure sleeves. Each lever arm 9a,9b can execute its own individual oscillating movement.

This construction according to the invention guarantees a free balance of the forces, whereby only a low pressure of 20 bar, for example, is necessary to effect the sliding of the slide gate housing. The tar vapors produced can escape freely due to the open construction and therefore the danger of clogging is considerably reduced. The slide gate nozzle is particularly suited for high-melting metals such as steel.

While there has been disclosed what is considered to be the preferred embodiment and the best mode, it will be obvious to those skilled in the art that various changes and modifications may be made therein without departing from the scope of the invention.

We claim:

1. A slide gate nozzle for a casting vessel having discharge opening comprising a bottom housing for receiving a head plate, a closure frame elastically supported against said casting vessel in juxtaposition to said bottom housing, said closure frame (9) including a slide gate housing for receiving a slide plate and holding it pressed upwards against said head plate, and guide elements extending in a sliding direction relative to said head plate, said slide gate housing being slidable in said guide elements for pressing said slide plate against said head plate in a sliding direction thereof, the improvement comprising:

means pivotally connecting said slide gate housing with said closure frame, said closure frame includes two spaced independent arms and said pivotal connection means including a rocker frame for each said arms, means pivotally connecting said rocker frame to its said respective arm to form a pivot axis which extends transversely to the sliding direction, and roller guidance means connected with each said rocker frames to cooperate with said guide elements.

2. The slide gate nozzle as claimed in claim 1 wherein said roller guidance means includes roller bearings.

3. The slide gate nozzle as claimed in claim 1, wherein said rocker frame is formed as an obtused-angled isosceles triangle having its apex pivotally connected with the arm, and said roller guidance means includes roller bearings connected with each of the base corners of said isosceles triangle rocker frame, one of said roller bearings forming a front bearing and the other of said bearings forming a rear bearing each having an axis positioned on opposite sides of said pivot axis.

4. The slide gate nozzle as claimed in claim 1, wherein said arms are positioned alongside said slide gate housing and are transversely spaced therefrom.

5. The slide gate nozzle as claimed in claim 1 or 3, wherein said pivot axis is situated approximately half way between the open and closed positions of said slide plate.

6. The slide gate nozzle as claimed in claim 1 or 3, including means pivotally connecting one end of said arms to one end of said bottom housing, and closure means associated with the other end of said arms and the other end of said bottom housing.

7. The slide gate nozzle as claimed in claim 6, wherein said closure means includes:

a snap closure on said bottom housing, and pressure sleeves and a cross-strut connected therewith for snap engagement with said snap closure in a closed condition of said closure frame and said bottom housing.

8. The slide gate nozzle as claimed in claim 1, including adjustable means on said arms for adjusting the connection of said means pivotally connecting said rocker frame to said arm whereby to adjust the position of the pivot axis in the sliding direction.

9. The slide gate nozzle as claimed in claim 1, wherein said guide elements include a pair of guide rails having a bearing surface and being fixed to said slide gate housing, said closure frame includes two spaced independent arms positioned on opposite sides of said guide rails and each having one end pivotally connected with said bottom housing, said rocker frame for each said arms having three spaced corners, said pivotal means pivotally connecting one of said corners with said arm to form pivot axis which extends transversely to the sliding direction and is positioned between said two other corners of said rocker frame, and a guide roller for each of said two other corners rotatably connected with said rocker frame, each said guide roller having an axis, the axes of said guide rollers being positioned on opposite sides of said pivot axis, said slide gate housing being freely movable in the sliding direction with said bearing surface of said guide rails moving over said guide rollers, said guide rollers together with said rocker frames together assures adjustment in the longitudinal axis.

* * * * *

UNITED STATES PATENT AND TRADEMARK OFFICE

CERTIFICATE OF CORRECTION

PATENT NO. : 4,220,269

DATED : September 2, 1980

INVENTOR(S) : Karl D. Beckers et al

It is certified that error appears in the above—identified patent and that said Letters Patent is hereby corrected as shown below:

Column 2, Line 57 change "liver" to --lever--

Column 6, Line 7 change "13aa" to --13a--

Column 6, Line 12 change "14A" to --14a--

Signed and Sealed this

*Thirty-first* Day of *March 1981*

[SEAL]

*Attest:*

RENE D. TEGTMEYER

*Attesting Officer*

*Acting Commissioner of Patents and Trademarks*